United States Patent [19]

Brutel et al.

[11] Patent Number: 4,598,880

[45] Date of Patent: Jul. 8, 1986

[54] PERFORATED CORE FOR A TEXTILE YARN PACKAGE

[75] Inventors: Jean-Pierre Brutel, Ecully; Yvon Leray, Loriol-S/Drome; Louis Quey, Lyons, all of France

[73] Assignee: Rhone-Poulenc Fibres, Lyons, France

[21] Appl. No.: 795,730

[22] Filed: Nov. 8, 1985

Related U.S. Application Data

[63] Continuation of Ser. No. 627,477, Jul. 3, 1984, abandoned.

[30] Foreign Application Priority Data

Jul. 4, 1983 [FR] France ..... 83 11215

[51] Int. Cl.[4] ..... B65H 75/18; B65H 75/20; B65H 75/10

[52] U.S. Cl. ..... 242/164; 242/118.1; 242/174; 8/155.1; 57/129; 57/362; 68/198; 428/36

[58] Field of Search ..... 428/36, 131; 242/118, 242/118.1, 174, 164; 68/198; 57/129, 362; 8/155, 155.1

[56] References Cited

U.S. PATENT DOCUMENTS

| | | | |
|---|---|---|---|
| 2,110,926 | 3/1938 | Williams | 57/129 |
| 2,217,459 | 10/1940 | Slaughter | 68/198 |
| 2,746,280 | 5/1956 | Russell | 68/198 |
| 3,015,945 | 1/1962 | Jungbecker | 242/118.1 |

FOREIGN PATENT DOCUMENTS

| | | | |
|---|---|---|---|
| 1278065 | 9/1968 | Fed. Rep. of Germany | 68/198 |

*Primary Examiner*—Alexander S. Thomas
*Attorney, Agent, or Firm*—Sherman and Shalloway

[57] ABSTRACT

A rigid core for a textile yarn package particularly for dyeing is cylindrical in shape, corrugated over the whole outer peripheral surface corresponding to the package, and has a part situated at one end which is provided with a groove, incorporating perforations of a maximum diameter of 2 millimeters, which is intended for forming a yarn reserve, a central part perforated with tapered orifices, wider at the outer surface than the inner, with an angle of taper, relative to the axis of the respective orifice, being between 2° and 80°, preferably between 20° and 70°, and two interengably shaped ends to permit the fluid-tight nesting of the cores on each other during the dyeing.

The method of using such a yarn package in which a textured continuous polyester yarn is reeled at a speed of between 400 and 1,000 m/min.

11 Claims, 1 Drawing Figure

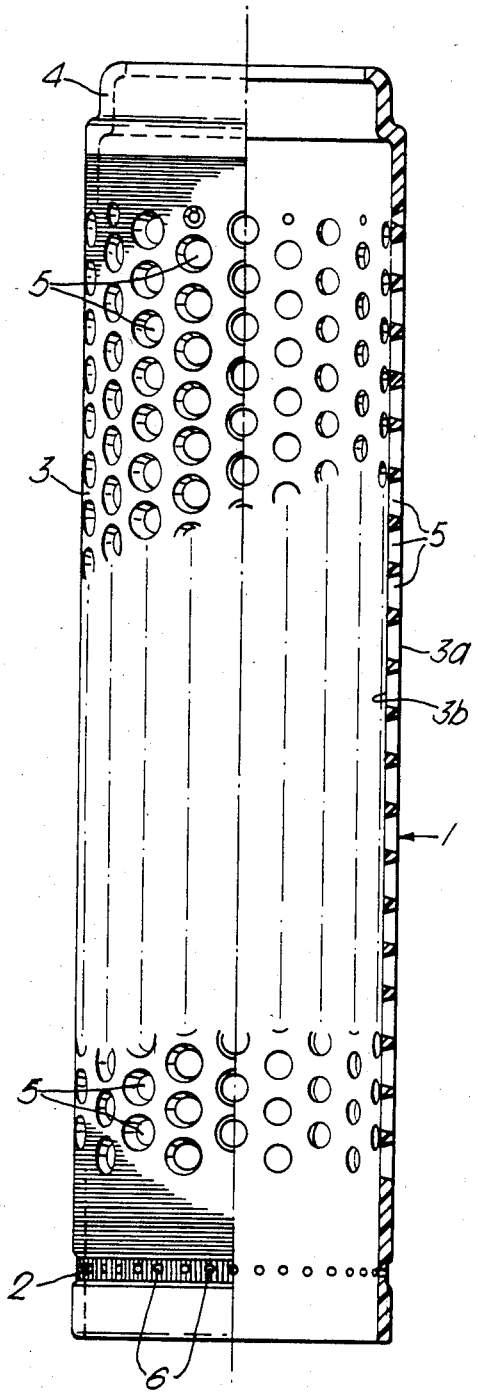
4
5
3
5
3a
3b
1
5
2
6

PERFORATED CORE FOR A TEXTILE YARN PACKAGE

This is a continuation of application Ser. No. 627,477, filed July 3, 1984, now abandoned.

The present invention relates to a perforated core for a textile yarn package, in particular a textured yarn with a view, inter alia, to its being coloured by dyeing.

For dyeing textile yarns, it is generally known to use either hank dyeing or dyeing of wound yarns in the form of a package. To do this, in the latter case, the yarn is reeled on a retractable sleeve or core, under a relatively low tension, in order to produce a soft package, of a weight which is generally below 1.5 kilograms, which subsequently permits good circulation of the dye bath and its uniform distribution in the yarn. The use of such packages, of importance for the dyeing of spun fibres, is even more important for the dyeing of regenerated and synthetic continuous yarns, the fragility of which is known. After dyeing, the yarn is again rereeled in order to form a package of a standard weight and yarn package density. Thus, from an economic standpoint, the conventional processes for dyeing yarn in the form of packages, by the process of dyeing a stack of packages on perforated cores, require numerous yarn handling operations, which is unprofitable, not to mention the faults, such as, breaks which it may cause. Furthermore, the yarn is wound on cores which are employed only for dyeing it and which must have precise characteristics to permit uniform circulation of the bath and to withstand the temperatures and pressures exerted by the liquid and the layers of yarn forming the packages during the operation.

Thus in French Patent Application published under the No. 2,380,215, there is proposed a core for dyeing a yarn, which is perforated, and in which the cross-section of the holes increases from the interior towards the exterior of the core, the surface area of the flow cross-section of all the orifices of the core being not greater than 9 $cm^2$ per kilogram of yarn winding; it is stated therein that packages of a weight of approximately 0.8 kilogram are usually mounted on such cores for dyeing. In French Patent Application published under the No. 2,380,214, there is proposed a perforated core with a frustoconical outer surface and a cylindrical inner surface the inner wall of which nests accurately with that of the other cores to avoid flow turbulence in the bath.

In French Patent Application under the No. 2,322,958 a retractable core for dyeing is proposed, which is cylindrical, carries perforations and is capped with two partly rigid components at its two ends.

Thus, none of the cores proposed above provides for winding of large quantities of yarn, and each still has a disadvantage. Either it permits the cores to be nested but its thickness, which can vary from one end of the core to the other, causes its strength to vary, and moreover this variable thickness results in a difference in the depth of the holes, which may interfere with the circulation of the bath, or the distribution and the section relationships of the holes are such that the package of the yarn on the core is at most 1 Kilogram.

According to the present invention there is provided a rigid core for a yarn package, said core comprising, a hollow body, having an interior surface and a generally cylindrical peripheral surface, with corrugations formed over the whole of said peripheral surface, a portion of said body adjacent one end thereof intended for forming a yarn reserve, said portion including an outer surface having a circumferential groove therein and a plurality of perforations extending from said interior surface to said groove and having a maximum diameter of 2 mm, a central part of said body, with tapered orifices perforating said body, and extending from the interior surface to the peripheral surface of said central part, with the diameter of the orifices greater at the peripheral surface than at the interior surface of the core, the angle of taper being between 2° and 80° with respect to the axis of the associated orifice and cooperating interengagable ends on said body, enabling the body to be nested with the body of at least one adjacent core, in a fluid tight manner. It is contemplated that the distribution of the orifices over the core should be such that the ratio of the core diameter in its central part before and after dyeing is at most 1.25.

Preferably, the core is made of a plastics material such as polypropylene, which withstands the dyeing temperatures, capable of reaching 130° C. and mechanical stresses during the dyeing, such as the bath fluid pressure in combination with a possible shrinkage of the wound yarn.

The shape of the core permits the yarn to be dyed uniformly from one end to the other; thus, the groove which is perforated with orifices with a maximum diameter of 2 millimeters and which is situated at one end of the core, permits normal dyeing of the yarn reserve and the piecing tail between the groove and the main winding since there in no impediment to the circulation of the bath from the inside to the outside of the core. The cooperating ends of the cores permits the cores to nest in a fluid-tight manner on each other, which is very important for the circulation of the bath under pressure from one end to the other of the perforated core or of a mandrel on which the cores for dyeing which carry the yarn are nested.

This shape can be produced by moulding a spigot at one end of the core which makes it possible to nest a plane end of another core. This fluid-light nesting also makes it possible to eliminate dyeing inserts between each core. The core orifices are made divergent to permit maximum distribution of the dye bath flowing from the inside towards the outside. It has been found that, in respect of their conicity, the angle of between 2° and 80%, preferably between 20° and 70°, relative to the vertical axis passing through the centre of the orifices, permitted a good coverage by the fluid flows coming out of each orifice, and thus a homogeneous distribution, at the same pressure of the dye bath over the yarn. The term cylindrical is understood to mean a cylinder which is straight or slightly conical.

The core may be corrugated parallel to the core generatrices, in a circumferential sense or by crossed striations; these corrugations, of a small depth, generally of the order of 0.5 mm, preferably circumferential, permit good attachment to the core of the first layers of winding of a yarn.

The cores may be employed for the winding of any yarn, such as those in the form of spun fibres or regenerated and synthetic continuous yarns. The packages produced in this way do not move appreciably during dyeing and are capable of being easily unwound afterwards.

These cores will preferably be employed for the winding of synthetic yarns in various forms, either of stretched yarn, incompletely stretched yarn or incompletely stretched yarn of a flat form or textured.

The invention also provides a method of winding a yarn comprising providing a core according to the invention, winding on to the core a yarn with an angle of crossing of the yarn between 25° and 35°, arranging for the package density of the yarn to be between 0.4 and 0.55, winding the package so that it is cylindrical and has, at its ends, truncated sides of an angle of between 15° and 25° and so that the package produced weighs between 2.5 and 4.5 kg.

It has been found, in fact, that by employing the practically undistortable cores of the invention, it is possible to use them directly as package cores on a frame, in particular a texturing frame, and thus to maintain the package for the dyeing and delivery to the customer.

It was known to use perforated dyeing cores as winding cores; however, the packages produced directly on a commercial perforated core or sleeve have a density of approximately 0.2, to permit the dyeing operation. Moreover, after dyeing, the textured yarn is unwound, rewound again in package form on full cores, the packages, in general conical, which are produced weighing only 1.5 to 2 kilograms. The package density of the method of the invention is between 0.40 and 0.55, preferably between 0.45 and 0.50; if the density is below 0.40, problems arise in unwinding the yarn after dyeing; if, on the other hand, the density is greater than 0.50, the yarn packages are too tight and, with poor bath circulation taking place, the problem which then arises is that of the uniformity of dyeing. The package is cylindrical and has sides which are truncated at the ends. The choice of the angles of the truncated ends makes it possible to have a good uniformity of dyeing; they are generally between 15 and 25°, preferably 18° and 20°. With the perforated cores of the present invention it is possible to carry out the texturing of continuous yarns at speeds of between 400 and 1,000 m/min, preferably between 550 and 750 m/min, and therefore under normal conditions which are not prejudical to the economic results. Moreover, the yarn which remains on a core may be dyed and then delivered to the customers in the form of a package having the characteristics shown above, and there is therefore no intermediate handling which is detrimental to the quality of the yarn and to the economic conditions for producing dyed packages. The angle of crossing of the yarn on the package permits, despite the package density, a good circulation of the bath, and hence good uniformity of dyeing. Insofar as the yarn reserve is concerned, this depends, in general, on the operator. The presence of orifices, in the reserve region, likewise permits a good circulation of the bath and good yarn unifomity from one end of the package to the other without giving rise to waste. This therefore represents a benefit for the user, who can thus have packages of continuous textured fine yarns of weights which can reach up to 4.5 kilograms, and thus without piecing together yarn from several packages; in this way the user gains in respect of productivity and quality of his products.

In order that the present invention may more readily be understood the following description is given, merely by way of example, reference being made to the accompanying drawing in which the sole FIGURE is a side elevation, partly in section, of one embodiment of core according to the invention.

The illustrated core 1 comprises a reserve part 2 which is shown including a circumferential groove provided with longitudinally extending corrugations. The core 1 also includes a central part 3 extending along the majority of the length this central part being perforated by tapered orifices 5 which have a greater diameter where they meet the outer peripheral surface 3*a* of the central part than the internal surface 3*b* forming the interior of the hollow body 1.

The end part 4, shown at the upper portion of the FIGURE, is shown as being of reduced diameter so that it can form a spigot for inserting in the opposite end of a similar core. This opposite end may itself be of widened internal diameter, thus to form a socket or it can have the same internal diameter as the remainder. Thus any form of spigot or socket connection can be provided.

It will be seen that the orifices 5 are in rows extending parallel to the axis, the orifices of adjacent rows being staggered with respect to one another. Extending into the groove 2 are further orifices 6 of less than 2 mm diameter.

In this way it has been possible to produce good stable packages with good dye uniformity, capable of being delivered directly to the customers, where they have excellent unreeling characteristics.

The following examples are given only by way of illustration.

EXAMPLE 1

A textured, false twist, continuous yarn, having a count of 167 dtex/30 ply, made of polyethylene-terephthalate, was produced on a SCRAGG SDS 8 texturing frame, from a partly stretched yarn, stretch ratio: 1.612, temperature of the first oven: 200° C., temperature of the second oven: 180° C.

The textured yarn is wound at 597 m/min on a polypropylene core, as shown in the drawing, 289 mm in length, 75 mm in outside diameter, 3 mm in wall thickness with the peripheral surface corrugated to circumferential corrugations of depth 0.3 mm, the perforated length being 224 mm, number of holes: 24 rows of 20 holes arranged in zig-zag around the circumference of the core, outer diameter of the orifices: 9 mm, inner diameter of the orifices: 7 mm. Around the circumference, the groove under the reserve, 8 mm wide, 2 mm in depth, is situated 15 mm from the end of the core, and the other end of the core incorporates a step 12 mm in length, 3 mm in depth, to permit nesting of the cores. The traveller stroke for winding the yarn is 235 mm at the beginning, the cylindrical package with conical sides which is obtained has a truncated side angle of 18°, a weight of 4 kilograms, a diameter of 250 mm, a density of 0.48, and an angle of crossing of the yarns of 30°.

The bobbins obtained in this way are dyed on manifolds in lots of 24 cores in an 880 liter autoclave, to a "billiards" green colour under the following conditions: autoclave filling with cold water, rise to 80° C., addition of the following adjuvants:

- 0.8 cc/liter of wetting agent SUNAPTOL LT CS (ICI/FRANCOLOR)
- 0.5% of carrier REMOL LS (HOECHST)
- 0.5 g/liter of acetic acid 0.45 g/liter of Eulysine S acid generator (B.A.S.F.)

The temperature is held at 80° C. for 10 minutes and then the colourants are added:

- 0.60% of Palanil B Blue (B.A.S.F.)
- 0.27% of Palanil 3 G Yellow (B.A.S.F., C.I.=Yellow 64)
- 0.41% of Flavine 8 GFF (CIBA GEIGY, C.I.=YELLOW 82)

The temperature remains at 80° C. for 10 Minutes.

The temperature is raised from 80° to 130° C., left at this value for 25 minutes, and the autoclave is then cooled gradually to 80°/90° C., and is then drained.

It is again filled with cold water, then the temperature is raised to 85° C. and the stripping products are added to it:

soda 1.17 g/liter sodium hydrosulphite 1.33 g/liter

The contents are left at 85° C. for 15 minutes, cooled and then drained. They are washed for 10 minutes with water at 80° C., then with cold water for the same length of time, and drained. The autoclave is then filled with water at 40 C. and 1.5% of a brightening agent and softener Avivan SO, (CIBA GEIGY) is added, left for 20 minutes and drained. Direction of bath flow from the inside outwards.

After dyeing, the characteristics of the bobbin are almost unchanged.

In use, the (when knitted) yarn has good uniformity, there are no problems with unwinding the packages, the piecing tail, and the yarn reserve are dyed without any problems and with the same uniformity as the remainder of the yarn.

EXAMPLE 2

The procedure is as in Example 1 but with a semimatt two-end yarn of count 167/30 dtex/ply, temperature of first oven: 220° C., second oven: 110° C., reeling of the textured yarn at 597 m/min.

The package obtained weight 4 kilograms, has a diameter of 230 mm, and a density of 0.46. The perforated core for reeling and dyeing is the same as in Example 1.

The dyeing is carried out using the same process as in Example 1; the required colorant Bleu Vitrail (stained Glass Blue) is obtained as follows:

2.32% of Resoline FBL Blue (BAYER, C.I Blue 56)

0.05% of Foron S 3 RL Brilliant Violet (SANDOZ, C.I Violet 63).

Finally, oiling the Paratex PE at a concentration 15 of 3% (PETRONAPHITE) is carried out.

As in the preceding example, uniformity is good (found after knitting the yarns), and the unreeling characteristics are good.

What is claimed is:

1. A rigid cylindrical hollow perforated core for receiving the windings of a yarn package and for subsequent uniform dyeing of said yarns in said package and delivery of the dyed yarn package to the end user, said core comprising (A) a hollow cylindrical rigid body having an interior surface and an exterior cylindrical peripheral surface, a circumferential groove in the peripheral surface at one end of said body for winding reserve yarn, said groove having a plurality of perforations extending from the interior surface to the groove, said perforations having a maximum diameter of 2 millimeters, a portion at the opposite end of said body being sized for nestingly interengaging, in fluid tight interengagement, with the circumferentially grooved end of an adjacent core, and a central portion extending between said circumferential groove and said nesting portion, said central portion including a plurality of tapered orifices perforating said body and divergingly tapering from the interior surface to the external cylindrical peripheral surface to permit dyeing of the yarn package by flowing a dye solution through the hollow body, said orifices being distributed over the central portion such that the ratio of the diameter of the core before and after dyeing a yarn package which has been wound to a density of from 0.4 to 0.55 and which weight from between 2.5 to 4.5 kilograms is at most 1.25, the peripheral surface of said central portion being corrugated to facilitate the attachment to the core of the first several layers of yarn windings.

2. The rigid core of claim 1 which is fabricated of a plastic material.

3. The rigid core of claim 2 wherein said plastic material comprises polypropylene.

4. A textured yarn package comprising a core and a plurality of winding layers of textured synthetic filament yarns wound on the core, said core comprising (A) a hollow cylindrical rigid body having an interior surface and an exterior cylindrical peripheral surface, a circumferential groove in the peripheral surface at one end of said body for winding reserve yarn, said groove having a plurality of perforations extending from the interior surface to the groove, said perforations having a maximum diameter of 2 millimeters, a portion at the opposite end of said body being sized for nestingly interengaging, a fluid tight interengagement, with the circumferentially grooved end of an adjacent core, and a central portion extending between said circumferential groove and said nesting portion, said central portion including a plurality of tapered orifices perforating said body and divergingly tapering from the interior surface to the external cylindrical peripheral surface to permit dyeing of the yarn package by flowing a dye solution through the hollow body, said orifices being distributed over the central portion such that the ratio of the diameter of the core before and after dyeing a yarn package which has been wound to a density of from 0.4 to 0.55 and which weighs from between 2.5 to 4.5 kilograms is at most 1.25, the peripheral surface of said central portion being corrugated to facilitate the attachment to the core of the first several layers of yarn windings, said plurality of wound layers of yarn forming a cylindrical yarn package on said central portion, the lateral sides of said package being truncated at an angle between 15° and 25°, the weight of the yarn package being between 2.5 and 4.5 kilograms and having a density between 0.4 and 0.55, and wherein the windings of adjacent winding layers is such that the angle of crossing of the yarns and adjacent winding layers is in the range of from 25° to 35°, said package being suitable for dyeing and subsequent direct use without intervening winding, said package further comprising a yarn reserve in said circumferential groove.

5. The textured yarn package of claim 4 wherein the angle of taper of the tapered orifice is between 2° and 80° relative to the axis of the orifices.

6. The textured yarn package of claim 4 wherein the yarn in the yarn reserve and yarn package are uniformly dyed, said dyeing operation having been carried out after said yarn has been wound on said yarn package.

7. A method of winding a yarn package having a plurality of wound layers of yarn on a core, comprising (A) using as said core a hollow cylindrical body having an interior surface and an exterior cylindrical peripheral surface, a circumferential groove in the peripheral surface at one end of said body for winding reserve yarn, said groove having a plurality of perforations extending from the interior surface to the groove, said perforations having a maximum diameter of 2 millimeters, a portion at the opposite end of said body being sized for nestingly interengaging, in fluid tight interengagement, with the circumferentially grooved end of an adjacent core, and a central portion extending between said circumferential groove and said nesting portion, said central portion including a plurality of tapered orifices perforating said body and divergingly tapering from the interior surface to the external cylindrical peripheral surface to permit dyeing of the yarn package by flowing a dye solution through the hollow body, said orifices being distributed over the central portion such that the ratio of the diameter of the core before and after dyeing a yarn package which has been wound to a density of from between 0.4 to 0.55 and which weight from between 2.5 to 4.5 kilograms is at most 1.25, the peripheral surface of said central portion being corrugated to facilitate the attachment to the core of the first several layers of yarn windings, (B) winding a plurality of layers of yarn on said central portion to form a cylindrical yarn package, the lateral sides of which are truncated at an angle of between 15° and 25°, until the yarn package weighs between from 2.5 to 4.5 kilograms and has a package density of between from 0.4 to 0.55, and wherein the winding of adjacent winding layers is such that the angle of crossing of the yarns in adjacent winding layers is in the range of from 25° to 35°, and (C) forming a yarn reserve in said circumferential groove.

8. The method of claim 7 wherein the wound yarn is textured synthetic continuous yarn.

9. The method of claim 8 wherein the textured continuous synthetic yarn is comprised of polyethylene terephthalate.

10. The method of claim 8 which comprises winding the textured yarn on the core at a winding speed of between 400 and 1,000 meters per minute.

11. The method of claim 7 which further comprises circulating a dye bath through the hollow body and through the perforations in said groove and the tapered orifices in said central portion whereby the yarn in said yarn reserve and the yarn in said yarn package are uniformly dyed, said dyed yarn package being suitable for delivery directly to the end user for subsequent processing.

* * * * *

UNITED STATES PATENT AND TRADEMARK OFFICE

CERTIFICATE OF CORRECTION

PATENT NO. : 4,598,880

DATED : July 8, 1986

INVENTOR(S) : JEAN-PIERRE BRUTEL, ET AL.

It is certified that error appears in the above-identified patent and that said Letters Patent is hereby corrected as shown below:

IN THE CLAIMS

Claim 1, line 27, (column 6, line 3),
after "from", insert --between--.

Claim 4, line 12, (column 6, line 24),
delete "a", insert --in--.

line 25, (column 6, line 37),
after "from", insert --between--.

Claim 7, line 25, (column 7, line 19),
delete "weight", insert --weighs--.

Signed and Sealed this

Seventh Day of October, 1986

[SEAL]

*Attest:*

DONALD J. QUIGG

*Attesting Officer*

*Commissioner of Patents and Trademarks*